United States Patent [19]

Alazet

[11] Patent Number: 4,830,004

[45] Date of Patent: May 16, 1989

[54] DEPILATING APPLIANCE

[76] Inventor: Jean Alazet, 26, rue des Fossés Saint Bernard, F-75005 Paris, France

[21] Appl. No.: 68,267

[22] PCT Filed: Oct. 22, 1986

[86] PCT No.: PCT/FR86/00364

§ 371 Date: Jun. 9, 1987

§ 102(e) Date: Jun. 9, 1987

[87] PCT Pub. No.: WO87/02557

PCT Pub. Date: May 7, 1987

[30] Foreign Application Priority Data

Oct. 23, 1985 [FR] France ..... 85 15735

[51] Int. Cl.[4] ..... A61B 17/00

[52] U.S. Cl. ..... 128/355; 17/11.1 R; 128/354; 132/73.5

[58] Field of Search ..... 30/43.42; 17/11.1 R, 17/47; 67/26; 128/354, 355; 132/73.5, 73.6, 75.3, 75.6

[56] References Cited

U.S. PATENT DOCUMENTS

| | | | |
|---|---|---|---|
| 1,065,438 | 6/1913 | Maclaren | 17/11.1 R |
| 2,004,581 | 6/1935 | Meyer | 17/11.1 RX |
| 2,917,056 | 12/1959 | Dolan, Sr. | 132/75.8 |
| 3,081,782 | 3/1963 | Funk | 132/73.6 |
| 4,079,741 | 3/1978 | Daar et al. | 128/355 |
| 4,179,772 | 12/1979 | Harben | 17/47 |

FOREIGN PATENT DOCUMENTS

| | | |
|---|---|---|
| 0147285 | 7/1985 | European Pat. Off. . |
| 0275458 | 11/1926 | Fed. Rep. of Germany . |
| 1703736 | 2/1972 | Fed. Rep. of Germany . |
| 2307491 | 11/1976 | France . |
| 2334320 | 7/1977 | France . |

*Primary Examiner*—Douglas D. Watts
*Attorney, Agent, or Firm*—Young & Thompson

[57] ABSTRACT

The disclosed depilation apparatus comprises movable members for pulling out hair to be removed, said members being driven by an electric motor housed inside a casing capable of being hand-held. The pulling out members provided in said apparatus consist of two movably mounted combs in translation with respect to the same axis (X-Y) has the motor-actuated driving member (3), and which is imparted with an alternating translation motion. However, only one of said combs is coupled with said driving member, the other comb being mounted idle. Furthermore, the teeth of both combs are arranged in a same plane and interleaved between each other with a certain gap in order to make possible the pinching and pulling out of hair to be removed. Said apparatus is intended to be used for remove hair from the skin.

7 Claims, 3 Drawing Sheets

FIG.3
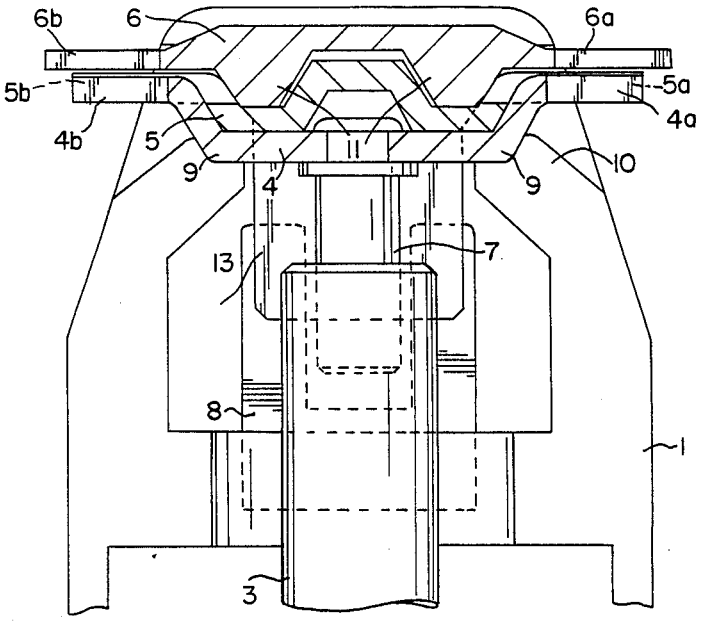
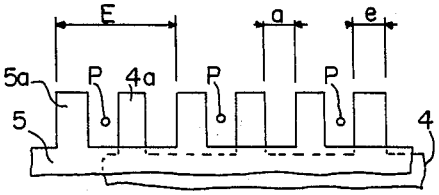
FIG.5
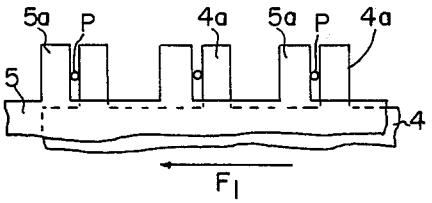
FIG.6
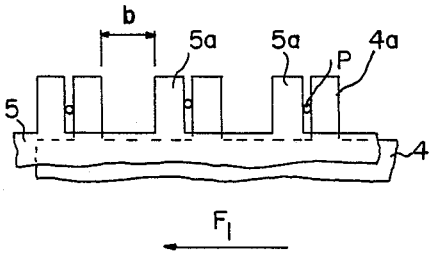
FIG.7

DEPILATING APPLIANCE

The present invention relates to depilating appliances which are so designed as to be held in one hand and which are provided with movable hair-plucking members driven by an electric motor housed within a small casing.

A certain number of appliances of this type already exist.

Thus French patent application 2,307,491 describes an appliance in which two pairs of rollers rotate in opposite directions for plucking-out hairs as they engage between these latter. This appliance, however, is of limited efficiency. This is due to the nature of the elements employed for plucking hairs. These latter are in fact not gripped between the two rollers in a sufficiently effective manner. Furthermore, the point at which the hairs are effectively gripped between the two rollers, or in other words the point of contact between these latter, is necessarily set back with respect to the corresponding end of the casing of the appliance. In consequence, this appliance is capable of gripping and plucking-out only hairs which already have a certain length.

There exist other depilating appliances which are also equipped with rotating rollers for plucking-out hairs, for example the appliance described in French patent application 2,334,320. However, the efficiency of these appliances is equally unsatisfactory. In addition, the cost price of these appliances is relatively high on account of the presence of the mechanisms which are necessary for driving in rotation the elements used for plucking-out hairs to be removed.

It is for these reasons that the object of the present invention is to produce a small appliance which has the same intended function but which is so designed as to offer optimum efficiency while nevertheless requiring limited capital outlay.

To this end, said appliance is essentially characterized in that the hair-plucking members provided in this latter are so designed that they can be coupled with an actuating member subjected to a reciprocating translational movement and they accordingly consist of two combs which are mounted for translational motion along the same axis as the motor-driven actuating member but only one of which is coupled with the actuating member whilst the other is mounted for free motion, the teeth of said two combs being located in interengaged relation in the same plane with a certain clearance between each other.

Thus, when the movable combs of this appliance are displaced on the skin, the hairs to be plucked-out engage quite naturally between the teeth of these latter. However, the displacement of the driven comb in one direction has the effect of gripping these hairs between the teeth of said comb and those of the free-motion comb which is subsequently actuated by the driven comb, thus having the effect of plucking-out the hairs. The same applies when the two combs subsequently move in the opposite direction, and so on.

Under these conditions, the present appliance is endowed with very high efficiency. However, by virtue of the very nature of its conceptual design, its working head is very simple and does not have any complicated or costly mechanism. Moreover, this working head can be driven by a mechanical device of very simple design of the same type as those provided in many electric shavers. Furthermore, the working head of the present appliance alone constitutes one of the objects of the present invention since said head can be adapted to the actuating dog provided in certain appliances which already exist.

In an advantageous embodiment of the present appliance, the movable combs of this latter are formed by two superposed plates, the longitudinal edges of which are cut-out on each side in such a manner as to form the teeth of the two pairs of combs and are elbowed so as to ensure that the interengaged teeth of each comb are located in the same plane.

However, other particular features and advantages of the present appliance will become apparent from the following description of one embodiment of this latter. This description is given solely by way of indication with reference to the accompanying drawings, in which:

FIG. 3 is a transverse view in cross-section along the line III—III of FIG. 2.

FIGS. 5, 6 and 7 are fragmentary overhead plan views of the two hair-plucking combs provided on one side of the working head; these views illustrate schematically three successive steps of the operation which involves gripping and plucking of hairs to be removed, with purposely exaggerated spacing of the teeth of the combs in order to gain a better understanding of the drawings.

The appliance in accordance with the invention comprises a small casing 1 which can be held in one hand and within which is provided an electric motor 2 supplied either through a connection to the electric current supply network or from incorporated dry cells or rechargeable storage batteries. By means of a suitable mechanism of the type provided in many electric shavers, said motor imparts a reciprocating movement of translation to an actuating arm or dog 3 having a free end located opposite to the end of the casing 1 which contains the working head of the present appliance.

Figure 1:
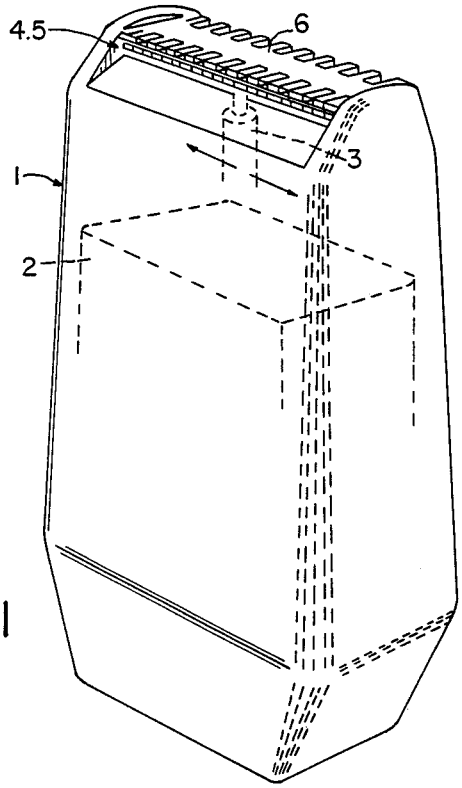
FIG. 1 is a partial view in perspective of a depilating appliance in accordance with the invention.
Figure 4:
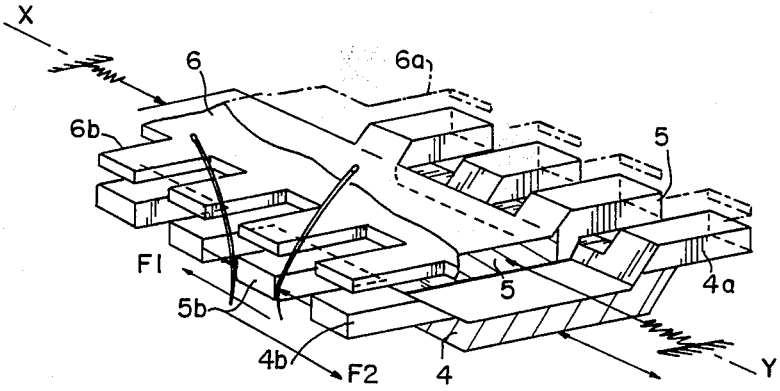
FIG. 4 is a partial view, in perspective and in transverse cross-section, of the movable combs of said working head.

In the example illustrated, said working head comprises two pairs of hair-plucking combs which are located on both longitudinal edges of said head. These combs are formed by two superposed plates 4 and 5, the longitudinal edges of which are cut-out on each side so as to constitute the teeth 4*a* and 5*a* of one of the two combs as well as the teeth 4*b* and 5*b* of the other comb. Moreover, these two plates have an elbowed portion on each side so as to ensure that their teeth are disposed in the same plane, these teeth being interengaged with a certain clearance (see FIG. 4).

Above the two plates 4 and 5 is mounted a fixed cover 6, the longitudinal edges of which are also cut-out so as to form the teeth 6*a* and 6*b* of two protective stationary combs. The two plates 4 and 5 are mounted so as to be capable of translational motion along the same axis X–Y as the actuating dog 3. However, only one of these plates, namely the lower plate 4 in this instance, is coupled with said actuating dog, for example by means of a stud 7 engaged within a blind-end bore 8 formed in the corresponding end of said actuating dog. In regard to the other plate 5, it is freely mounted for translational motion along the axis X-Y.

The lower plate 4 is guided in its movements by means of slideways 9 formed on the edges 10 of the corresponding end of the casing 1. So far as the upper plate is concerned, it is guided in its movements both by the lower plate 4 and by guide ribs 11 carried by the internal face of the fixed cover 6.

Figure 2:
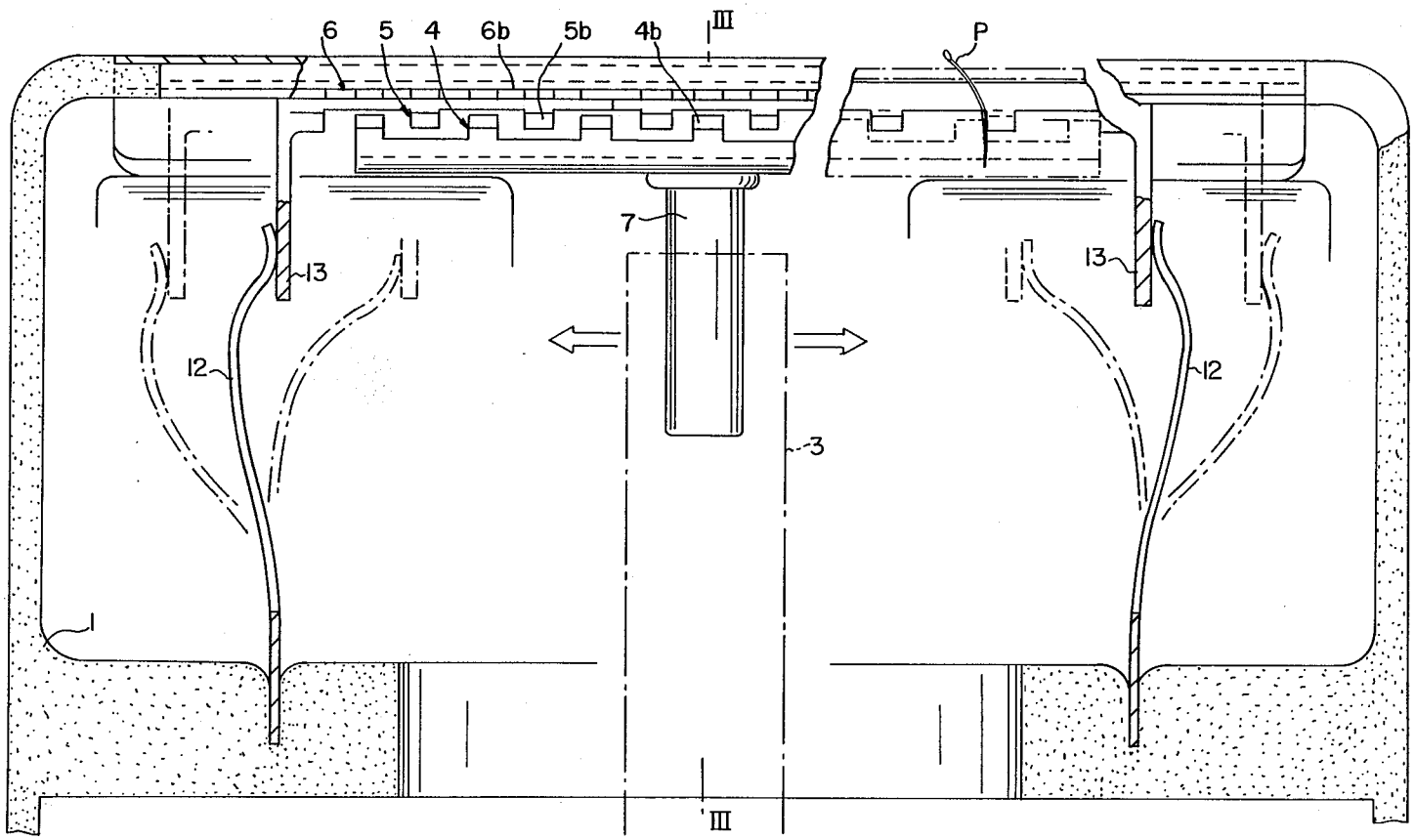
FIG. 2 is a view, partly in side elevation and partly in cross-section, of the working head of said appliance which is drawn to a different scale; the left-hand portion of this figure illustrates a position in which the teeth of the combs are relatively withdrawn whilst its right-hand portion represents a position in which said teeth are in contact on one side.

As already indicated, the teeth of the two movable combs of each pair are interengaged. However, the spacing E which exists between two successive teeth of one and the same comb is distinctly greater than the width e of each tooth of the other comb. Furthermore, when the actuating dog 3 is in its rest position shown in FIG. 2, each of the teeth 4*a* or 4*b* of the combs of the lower plate is located at the midpoint of the interval existing between two successive teeth 5*a* or 5*b* of the combs of the upper plate. There thus exists an interval a on each side of a tooth 4*a* or 4*b* of the lower plate (see FIG. 5). Under these conditions, hairs P to be removed can engage at this moment within these different intervals.

When the driven plate 4 begins its displacement in one direction, for example in the direction of the arrow F1, each of the teeth 4*a* or 4*b* of its combs first comes into contact with the opposite tooth 5*a* or 5*b* of the corresponding comb carried by the upper plate 5 which has remained motionless during this period of time. This accordingly has the effect of gripping between these teeth hairs P which had engaged within the intervals a (see FIG. 6). Thereupon, as the driven plate 4 continues its translational movement in the direction of the arrow F1, it is subsequently accompanied by the free-motion blade 5 by applying the teeth 4*a* and 4*b* of its combs against the teeth 5*a* and 5*b* of this second blade (see FIG. 7). This accordingly ensures plucking-out of the hairs P which had been imprisoned between the teeth of the pair of combs employed at that time for the hair-plucking operation.

After it has reached the end of its travel in one direction, the driven plate 4 is returned in the opposite direction by the dog 3. At the beginning of a movement of travel, there exists a maximum interval b between the teeth of the two combs employed for the hair-plucking operation, which permits engagement of hairs between these latter. The same process as before is then repeated at the time of continuation of the movement of the driven plate in the direction of the arrow F2, and so on.

The range of travel of the driven plate 4 in one direction and in the other can be for example of the order of 3 to 6 mm with an initial displacement of the order of 0.5 mm to 1 mm for gripping hairs between the teeth of the combs employed for the hair-plucking operation. However, these values are given here solely by way of indication.

In order to avoid excessive freedom of displacement of the free-motion plate 5, this latter can be mounted between two springs such as, for example, two blade springs 12 for exerting pressure on brackets 13 carried by each end of said plate. This results in resilient braking action on the free-motion plate 5, thus making it possible to obtain effective gripping of the hairs P between the teeth of the two combs employed for the plucking operation. However, the braking action of the upper free-motion plate 5 could be produced by other means such as, for example, resilient clamping pressure applied by this latter against the driven plate 4 or else by means of friction pads or other suitable braking members.

As can readily be understood, it is possible to employ either of the two pairs of movable hair-plucking combs provided on both longitudinal sides of the working head. By virtue of the fact that these hair-plucking combs are located on both sides, it is only necessary to displace in sliding motion either of the two longitudinal sides of the working head against the skin in order to pluck-out the hairs to be removed. During this operation, these latter engage very easily between the teeth of the combs employed by virtue of the very fact that these latter project from the corresponding edge of the working head. By reason of the mode of gripping hairs between the teeth of the hair-plucking combs in service, optimum efficiency of the present appliance is achieved. It is worthy of note in this connection that the hairs are gripped very close to their roots, thus making it possible to obtain effective plucking-out of hairs and not merely breaking or cutting of these latter.

Moreover, the inherent nature of the movements imparted to the driven plate of the working head permits the use of an actuating mechanism of very simple design which is consequently inexpensive. It is thus possible to employ an actuating mechanism of the type used for equipping certain electric shavers. If so required, it would even be possible to construct an appliance which can serve indifferently as an electric shaver or as a depilating appliance by providing two separate removably-mounted working heads which could serve in one case as a shaver and in the other case as a depilating appliance in accordance with the present invention.

In this connection, it should be borne in mind that the operating head of the present depilating appliance alone constitutes one of the objects of the present invention. This working head could in any case be marketed independently for adaptation to certain electric shavers or the like.

However, the appliance in accordance with the invention and its working head are not limited to the single example which has been described in the foregoing. It would thus be possible to provide a single pair of movable hair-plucking combs so arranged as to project from one of the longitudinal sides of the hair-plucking head. If so required, it would also be possible to provide an arrangement such that the teeth of the movable combs are located along the median longitudinal axis of the working head. In such a case, it would be preferable to design these teeth so as to have a curved shape and thus to facilitate engagement of the hairs to be plucked-out between these latter.

I claim:

1. Depilating appliance comprising movable members for plucking-out hairs to be removed which are actuated by an electric motor housed within a casing which can be held in one hand, and comprising an actuating member driven in a reciprocating movement of translation, wherein the hair-plucking members comprise two combs having spaced teeth which combs are mounted for translational motion along the same axis (X–Y) as the actuating member (3) and only one of which combs is coupled with the actuating member with the other being mounted for free motion, the teeth of said two combs being located in the same plane and positioned in interengaged relation to each other, with respective teeth of one of said combs being positioned in the space between two teeth of the other comb, the said space between said teeth being wider than the width of the said tooth positioned in said space so as to provide clearance between adjacent interengaged teeth.

2. Depilating appliance according to claim 1, wherein said two movable combs are formed by two superposed plates in which longitudinal edges located on the same side of each plate are cut-out in such a manner as to form the spaced teeth of said two combs and said teeth being angled so as to ensure that said interengaged teeth are located in the same plane.

3. Depilating appliance according to claim 1, comprising two pairs of movable combs which are formed by two superposed plates (4,5), the longitudinal edges of which are cut-out on each side so as to form said spaced teeth (4*a*, 5*a* and 4*b*, 5*b*) of the two pairs of combs and said teeth being angled so as to ensure that said interengaged teeth of each comb are located in the same plane.

4. Depilating appliance according to claim 2, further including a protective fixed top cover (6), and wherein the two superposed plates (4,5) are guided in their translational motion by guiding surfaces provided respectively on the casing (1) of the appliance and on said protective fixed top cover (6).

5. Depilating appliance according to claim 1, further including spring means (12) on each side of the free-motion comb which produce a braking action during displacement of said comb to ensure effective gripping of the hairs to be plucked-out between the interengaged teeth of the combs.

6. Working head for a depilating appliance according to claim 1, in which the members for plucking-out hairs to be removed are driven by an actuating member to which is imparted a reciprocating translational movement, and wherein said hair-plucking members consist of two combs which are mounted so as to be capable of translational displacement along the same axis (X-Y) as the motor-driven actuating member (3) and the teeth of said combs (4*a*, 5*a*, or 4*b*, 5*b*) are in interengaged relation with regard to each other, and said teeth being positioned at right angles with respect to the axis (X-Y) of displacement of the two combs, only one of said combs being engaged with the actuating member (7) with the other comb being mounted for free motion.

7. Depilating appliance according to claim 3, further including a protective fixed top cover (6) and wherein the two superposed plates (4,5) are guided in their translational motion by guiding surfaces provided respectively on the casing (1) of the appliance and on said protective fixed top cover (6).

* * * * *